US006648382B1

(12) United States Patent
Mönig et al.

(10) Patent No.: US 6,648,382 B1
(45) Date of Patent: Nov. 18, 2003

(54) OUTER DOOR HANDLE, ESPECIALLY FOR VEHICLES

(75) Inventors: Stefan Mönig, Schwelm (DE); Manfred Rohlfing, Essen (DE)

(73) Assignee: Huf Hülsbeck & Furst GmbH & Co. KG, Velbert (DE)

( * ) Notice: Subject to any disclaimer, the term of this patent is extended or adjusted under 35 U.S.C. 154(b) by 479 days.

(21) Appl. No.: 10/019,008

(22) PCT Filed: Jun. 21, 2000

(86) PCT No.: PCT/EP00/05734

§ 371 (c)(1),
(2), (4) Date: May 9, 2002

(87) PCT Pub. No.: WO01/00953

PCT Pub. Date: Jan. 4, 2001

(30) Foreign Application Priority Data

Jun. 25, 1999 (DE) ..... 199 29 022

(51) Int. Cl.[7] ..... E05B 3/00

(52) U.S. Cl. ..... 292/336.3; 292/DIG. 22; 292/DIG. 65; 292/DIG. 12

(58) Field of Search ..... 292/DIG. 22, 336.3, 292/347, DIG. 12, DIG. 65; 16/444

(56) References Cited

U.S. PATENT DOCUMENTS

| | | | | | |
|---|---|---|---|---|---|
| 3,719,248 | A | * | 3/1973 | Breitschwerdt et al. | 180/271 |
| 3,799,596 | A | * | 3/1974 | Nozomu et al. | 292/216 |
| 3,858,921 | A | * | 1/1975 | Kuki | 292/336.3 |
| 3,967,844 | A | * | 7/1976 | Torii et al. | 292/336.3 |
| 5,560,659 | A | * | 10/1996 | Dault | 292/336.3 |
| 5,669,642 | A | | 9/1997 | Kang | |
| 5,865,481 | A | * | 2/1999 | Buschmann | 292/216 |
| 5,961,166 | A | * | 10/1999 | Edwards | 292/336.3 |
| 6,007,122 | A | * | 12/1999 | Linder et al. | 292/336.3 |
| 6,042,159 | A | * | 3/2000 | Spitzley et al. | 292/216 |
| 6,070,923 | A | * | 6/2000 | Tanimoto et al. | 292/336.3 |
| 6,099,052 | A | * | 8/2000 | Spitzley | 292/336.3 |
| 6,241,294 | B1 | * | 6/2001 | Young et al. | 292/336.3 |
| 6,382,688 | B1 | * | 5/2002 | Agostini | 292/336.3 |
| 6,447,030 | B1 | * | 9/2002 | Meinke | 292/347 |
| 6,464,270 | B1 | * | 10/2002 | Sloan et al. | 292/336.3 |

FOREIGN PATENT DOCUMENTS

| | | |
|---|---|---|
| DE | 2023859 | 11/1971 |
| DE | 19610200 | 9/1997 |
| DE | 19625392 | 1/1998 |
| DE | 197 38 492 A1 | 3/1998 |
| DE | 197 56 344 A1 | 6/1999 |

* cited by examiner

*Primary Examiner*—Robert J. Sandy
*Assistant Examiner*—Dinesh Melwani
(74) *Attorney, Agent, or Firm*—Friedrich Kueffner

(57) ABSTRACT

An outer door handle for vehicles has a stationary housing in the vehicle door. The handle has a handle arm and acts on a lock arranged within the door. A pivotable latching member serves as a mass latching mechanism and makes the handle actuatable in a release position. Because of its inertia in a crash situation, the latching member reaches an active support position and blocks the handle. The pivot bearing for the latching member is located on the stationary housing. The movable handle arm has a shoulder. A counter shoulder is provided on the latching member. The folding movement path of the shoulder on the handle arm is intersected by the pivot movement path of the counter shoulder. In a crash situation the shoulder comes to rest against the counter shoulder. In the release position, the shoulder passes the counter shoulder upon handle actuation.

15 Claims, 3 Drawing Sheets

OUTER DOOR HANDLE, ESPECIALLY FOR VEHICLES

BACKGROUND OF THE INVENTION

1. Field of the Invention

The invention relates to an outer door handle comprising a housing stationarily arranged in the door, comprising a bearing for a manually actuatable handle on the housing, especially for a folding handle foldable about a hinge axis horizontally arranged or slantedly arranged relative to the horizontal, wherein the handle has a handle arm and upon handle actuation acts on a lock arranged within the door, and comprising a pivotable latching member serving as a mass latching mechanism, which is normally in an ineffective release position relative to a support surface provided on the housing and, in this way, makes the handle actuatable, which, however, as a result of the inertia of its masses, in a crash situation reaches an active support position on this support location and thus blocks the handle. Here, so-called "mass latching mechanisms" are provided which act as an automatic locking device on the folding handle in a crash situation. The mass latching mechanisms are formed as pivotable latching members and ensure that during a lateral impact on the vehicle the door with its lock remains in the locked state. During a crash, acceleration forces occur. These forces are used by the masses of the latching member. In a crash situation, the latching member is moved by these forces into a support position relative to a support surface on the housing where the movement of the handle is blocked.

2. Description of Related Art

In the known outer door handle of this kind (DE 196 25 392 A1) the pivot bearing for the latching member is on the movable handle arm. Here the latching member is supported in a freely pendulous way. In this known outer door handle, the handle arm which is foldable together with the handle, on the one hand, and the latching member pivotably supported on the handle arm, on the other hand, form a modular unit movable together upon handle actuation. In this connection, the latching member moves pendulously freely on the movable handle arm. In this outer door handle, the handle is a so-called "folding handle" where a hinge axle is supported horizontally within the housing. However, the invention is also suitable for outer door handles with handles embodied differently, for example, in connection with "pulling handles" discussed in the following. The latching member usually points away with its free mass end, which is provided with a toothing, from a counter toothing provided on the housing. In a crash situation the mass end of the latching member is pivoted by the active inertia forces and engages with its toothing the counter toothing on the housing. Already upon the handle actuation during regular use, undesirable blockage can occur by means of the latching member which is entrained. In the support position of the latching member the support forces are transmitted via the pivot bearing onto the handle arm. The strength of this support action depends on the stability of the bearing of the latching member on the handle arm.

Mass latching mechanisms are also known from outer door handles (DE 196 10 200 A1) which are configured as the already mentioned "pulling handles" having a vertical pivot axis at one end of the handle. The other end of the handle cooperates with a pivot arm which is supported, in turn, in the housing so as to be pivotable about a substantially vertical axis. The invention can be employed, as mentioned above, also for such outer door handles. In order to differentiate the movement of the pivot arm from the pivot movement of the latching member, in the following description the term "folding movement" will be used in this connection, even though this term more closely fits the aforementioned configuration of the door handled as a folding handle. In the known outer door handles configured as a pulling handle the mass latching mechanism is a pivotable spring-loaded lever supported rotatably in a pivot arm. In this case, the mass latching mechanism, in analogy to the known folding handle, is thus pivotably supported in a component movable by the pulling handle. Therefore, the analog disadvantages as in the case of the above discussed folding handle are present.

SUMMARY OF THE INVENTION

The invention has the object to develop an inexpensive, compact outer door handle of the aforementioned kind which is reliable and which withstands high loads. This is achieved according to the invention in that the pivot bearing for the latching member is located on the stationary housing, that the movable handle arm has a shoulder and that this shoulder has correlated therewith a counter shoulder on the latching member, that the folding movement path of the shoulder arranged on the handle arm is intersected by the pivot movement path of the counter shoulder on the latching member and in the crash situation the shoulder comes to rest against the counter shoulder, that, however, normally in the release position of the latching member, the shoulder on the handle arm passes the counter shoulder of the latching member upon handle actuation.

According to the invention, the latching member is not pivotably supported on a movable component, like the handle arm or the pivot arm provided for this purpose in the prior art, but on a stationary component, i.e., on the stationary housing. Accordingly, the pivot bearing axis can be arranged external to the force transmission path which receives the support forces during blockage. The support position in the crash situation is realized with the invention in that the movable handle arm with a shoulder comes to rests against a counter shoulder on the latching member because the latching member, as a result of the inertia forces occurring during the crash situation, has been pivoted previously into its support position relative to the support location, also provided here, on the housing. The folding movement path of the shoulder intersects the pivot movement path of the latching member which is entirety separately supported relative to it, i.e., on the housing. In the normal situation, when the latching member is in its release position, the folding movement path of the shoulder provided on the handle arm or the pivot arm extends past the counter shoulder of the latching member.

However, in the normal situation a certain deflection movement of the latching member can occur. Already during the conventional handle actuation a small pivot movement of the latching member occurs without the latching member reaching its full support position relative to the housing. With this empty run movement of the locking member, which results already in the normal situation, its functionality in the crash situation is ensured. A freezing of the latching member on its pivot bearing because of extended periods of non-use is therefore not to be feared.

BRIEF DESCRIPTION OF THE DRAWINGS

Further measures and advantages of the invention result from the further dependent claims, the following description, and the drawings. In the drawings the invention is illustrated with one embodiment. It is shown in:

DESCRIPTION OF PREFERRED EMBODIMENTS

Figure 1:
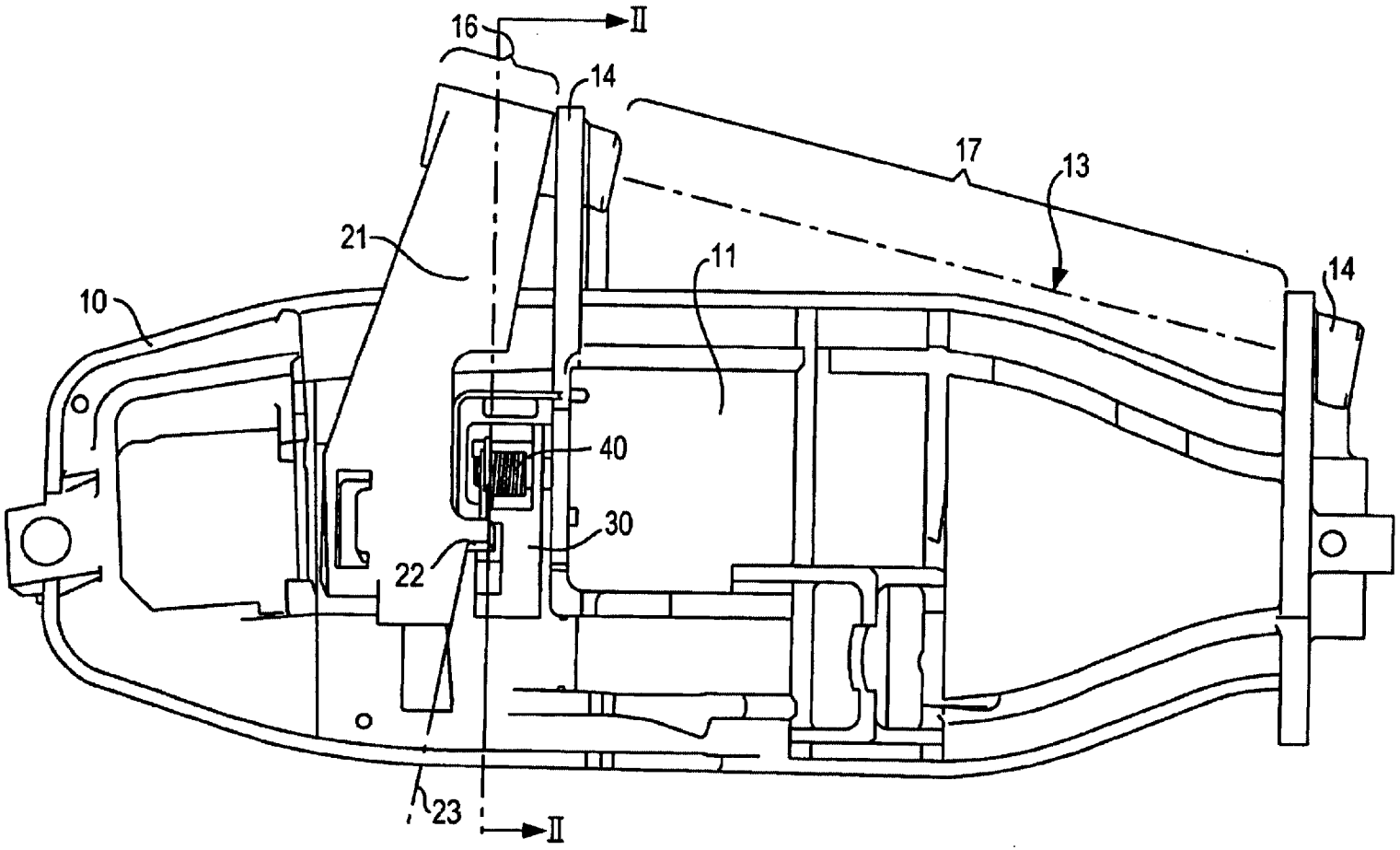
FIG. 1 the back side of the housing in a plan view which is provided with a folding handle not illustrated here.
Figure 2:
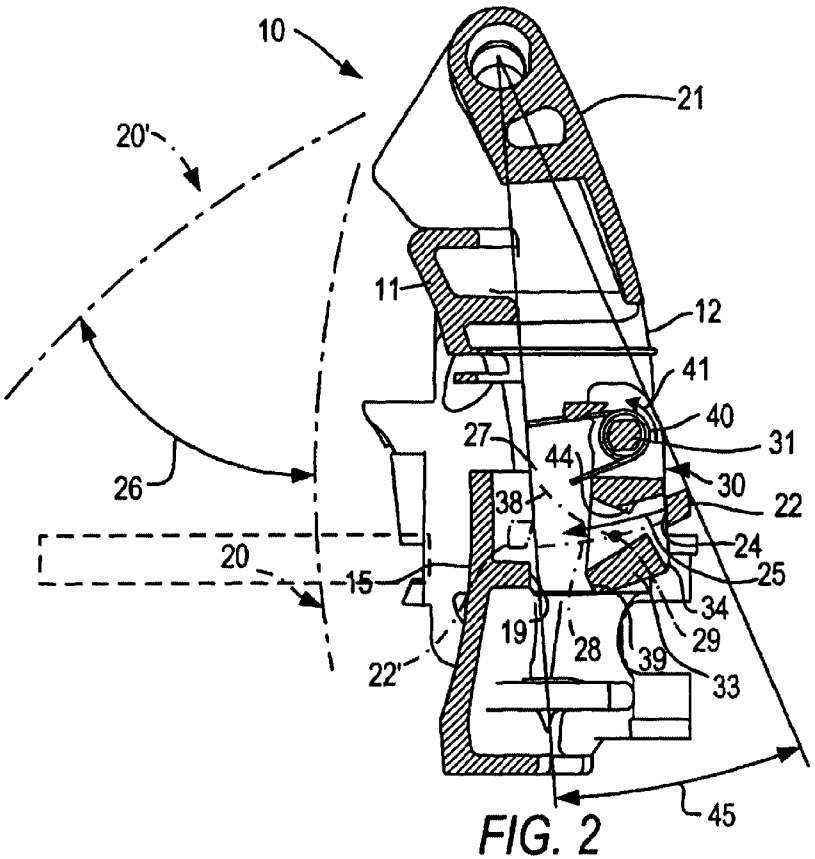
FIG. 2 a cross-section of the outer door handle of FIG. 1 along the indicated section line II—II in the rest position of the folding handle, which is indicated only by dash-dotted lines and whose pivot movement takes place together with the hatched handle arm, wherein the rest position as well as the working position of these components is illustrated.

The outer door handle illustrated in the Figures comprises a housing 10 of which in FIG. 1, as already mentioned, the backside 12 is visible. On the opposite front side 11 the actual manually actuatable handle 20 is arranged whose position, as already mentioned, is illustrated in FIG. 2 in a dash-dotted line. In the present case this is the folding handle already discussed above which is foldable about a hinge axis 13 arranged horizontally and indicated by dash-dotted lines in FIG. 1. In this connection, the housing 10 has two spaced-apart bearing brackets 14. The visible side 11 of the housing provides with a concave depression 15, illustrated in FIG. 2, which is at least partially covered by the folding handle 20 and is provided space for allowing engagement by the hand when using the handle.

In this embodiment a handle arm 21 is fixedly connected for common rotation to the folding handle 20 by connecting means, not illustrated in detail. The two components 20, 21 thus form a commonly moved modular unit upon handle actuation. While the folding handle 20 is arranged on the visible side 11 of the housing 10, the handle arm 12 is arranged at the backside. The handle 20 and the handle arm 21 are positioned angularly to one another. They are arranged on the same hinge axis 13 but on spaced-apart sections 16, 17. While the folding handle 20 is supported on the central section 17 positioned between the two brackets pairs 14, the arm 21 engages the outer section 16 of the hinge axis 13 arranged on one side of the bracket 14. Because of the slanted position of the hinge axis 13, the plane 23, illustrated in dash-dotted lines in FIG. 1, of the folding movement is also arranged at a slant, the folding movement being indicated in FIG. 2 by the arrow 25.

The hinge axis 13 could however also extend horizontally so that the folding movement plane 23 would then extend vertically. A nose 22 projects laterally from the handle arm 21, as illustrated in FIG. 1; the nose has a shoulder 24 at the side facing the housing 10 which shoulder is effective for entrainment. When the handle 20 has been moved from its rest position in FIG. 2 into its working position 20' by a handle actuation indicated by the arrow 26 in FIG. 2, the nose can enter through a cutout the interior 27 of the housing. In this working position 20' of the handle, the nose 22 has reached a working position 22' illustrated in FIG. 2 and also shown in dash-dotted lines. Its folding movement is illustrated by the arrow 25 and is carried out on the circular folding movement path 28 indicated in a dotted line in FIG. 2.

Figure 4:
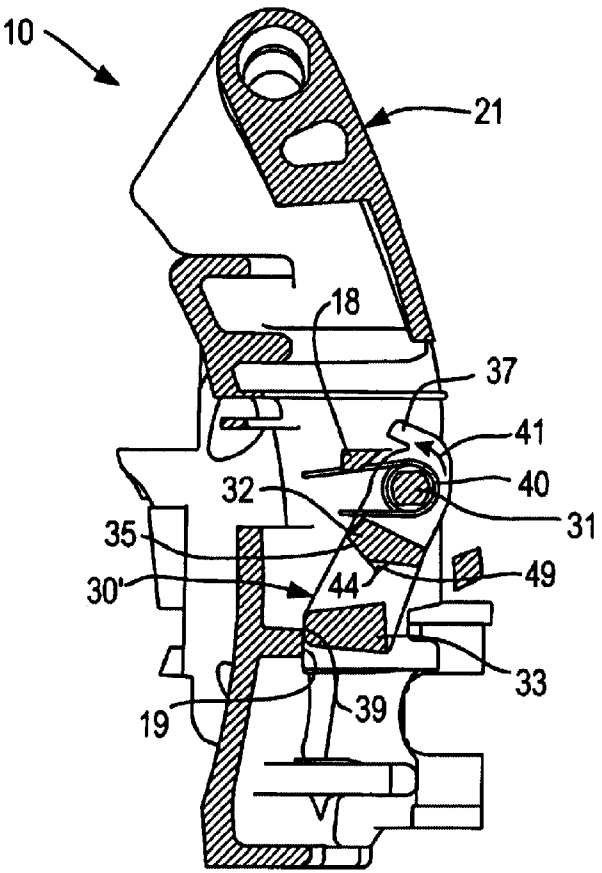
FIGS. 4+5 again the sections of FIG. 2 when a crash situation is present, in particular, in FIG. 4 the initial phase and in FIG. 5 the end phase of such an impact.

In the interior 27 of the housing a latching member 30 is arranged in a special way which acts automatically as a so-called "mass latching member". The latching member 30 is always stationarily supported for its pivot action by means of the pin 31 arranged in the housing 10. Its pivot movement path 38 is also indicated by a dotted line in FIG. 2. The latching member 30 is under the effect of a spring force 41 of a torsion spring 40 or the like which, as will be explained in more detail in connection with FIG. 4, is supported with one end on a cam 32 of the latching member and with the other end on a stationary stop 18 in the housing 10. By means of the spring force 41 the latching member 30 is secured in its position illustrated in FIG. 2. This position is determined by contacting a counter stop 37 provided on the latching member 30 and illustrated in FIG. 4 of the latching member on the already mentioned stop 18 in the housing 10. A counter cam 33 on the latching member 30 is correlated with the cam 32, as illustrated in FIG. 4, and determines one latching end 39 of the latching member 30. In the position illustrated in FIG. 2 of the latching member 30, this latching end 39 is at a spacing from a support location 19 provided on the housing 10. In the position of FIG. 2 the latching member 30, aside from the aforementioned spring force 41, is thus free so that this position will be referred to in the following as "release position" for short.

Figure 5:
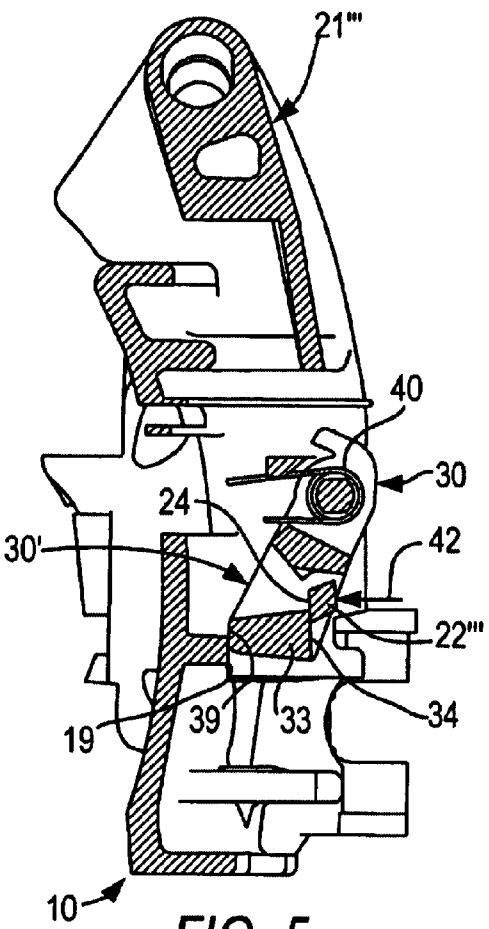

This is changed only when a crash situation occurs which is illustrated in FIGS. 4 and 5. In this case, inertia forces act on the masses of the two projections 32, 33 which transfer the latching member into the position 30' illustrated in FIGS. 4 and 5. The inertia forces that are caused are sufficient in order to overcome the small spring force 41. In this position 30' the latching end 39 of the latching member 30 is supported on the support location 19 of the housing. Accordingly, this position 30' will be referred to for short in the following as "support position" of the locking member. This support position 30' occurs in the crash situation.

The initial phase of the crash situation is shown in FIG. 4. In this connection, the latching member reaches very quickly the described support position 30' in the housing 10. The inertia forces which are caused by the acceleration in the crash situation act, of course, also on the handle 20 and on the handle arm 21 which is movable together with it. This modular unit 20, 21 is also under the effect of a restoring spring, not illustrated in detail, which has the tendency to secure the handle in the rest position 20 illustrated in FIG. 2. This handle spring, however, has a greater restoring force in comparison to the spring force 41 of the latching member 30, 30'. Because of this and because of the constructive conditions, the inertia forces occurring during the crash situation act only after a certain delay on this modular unit 20, 21. The handle arm may have moved in the crash situation into the minimally pivoted position 21''' illustrated in FIG. 5; however, a further pivot movement of the modular unit releasing the lock into the working position described in connection with FIG. 2 is prevented. The nose which is in the position 22''' of FIG. 5 is in fact supported by means of its aforementioned shoulder 24 on the counter shoulder 34 of the latching member which is in the support position 30'. This counter shoulder 34 in the present case is comprised of an end face of the counter cam 33. The inertia force which is illustrated in FIG. 5 by the force arrow 42 is transmitted by the nose 22''' via the counter cam 33, the latching end 39, and the support position 19 directly onto the housing 10 and thus becomes ineffective. When the inertia force 42 ends after the crash, the spring 40 returns the latching member again into the release position 30 illustrated in FIG. 2.

Figure 3:
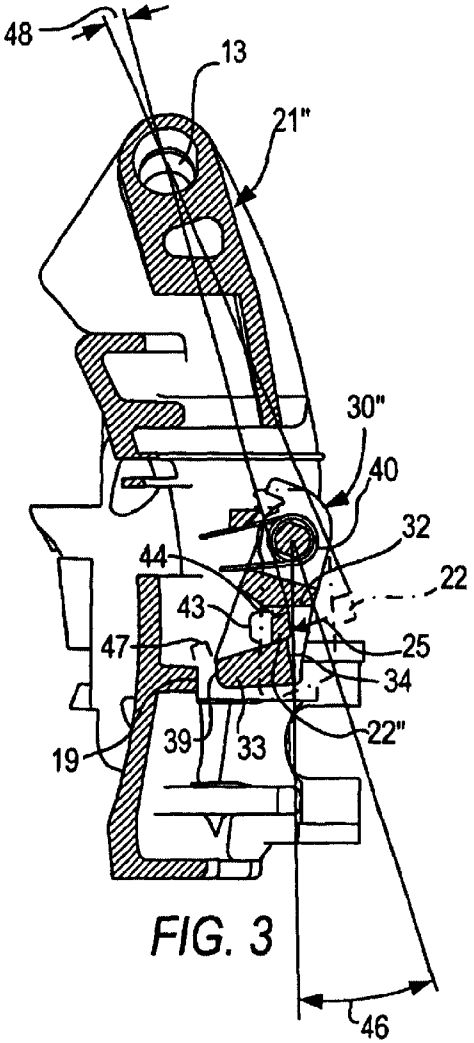
FIG. 3 in a section corresponding to that of FIG. 2 the same outer door handle when its folding handle is in an intermediate position between the two positions illustrated in FIG. 1.

As illustrated in FIG. 3, the counter shoulder 34 provided on the counter cam 33 forms one flank of a groove whose other groove flank is formed by the corresponding end face of the cam 32. The thus resulting groove 43 has an inner width which is somewhat greater than the width of the nose 22 provided on the handle arm. Accordingly, the nose can be moved from its already mentioned rest position 22, illustrated in solid lines in FIG. 2, along the folding movement path 28, also already mentioned and indicated by a dotted line, through the groove 43 into the already described working position 22', illustrated in FIG. 2 in dash-dotted lines, without this causing the aforementioned collisions between the shoulder 24 of the moving handle arm and the counter shoulder 34 of the latching member. The folding movement path 28, the described pivot movement path 38, and the counter shoulder 34 intersect one another, as illustrated in FIG. 2, at the point of intersection 29. This leads in the crash situation to the collision shown in FIG. 5. The groove 43 is however over portions thereof narrowed by a projection 44 illustrated in FIG. 3 so that already for a normal handle actuation 26 of FIG. 2 a small entrainment of the latching member 30 is realized which will be explained in more detail in connection with FIG. 3.

In the release position 30 of the latching member this projection 44 projects into the folding movement path of the nose 22 illustrated by arrow 25 in FIG. 2. This position is also indicated in FIG. 3 by dash-dotted lines. With this folding movement 25 the nose impacts on the projection 44 and entrains the latching member partially 46 up to an intermediate position 22". During the further course of the handle actuation 26 in which the nose describes the full angle 45 marked in FIG. 2, the latching member is again released. This point of release is illustrated in FIG. 3. Here the intermediate position 30" of the latching member is illustrated where at this moment the release of the projection by the nose 22" of the handle arm illustrated in the corresponding intermediate position 21' is realized. In this intermediate position 30" the latching member has been pivoted about a partial angle 46 which is smaller than the aforementioned full angle 45. In the intermediate position 30" the latching member with its latching end 39 is still clearly spaced from its support location 19 on the housing; between the components 19, 39 a gap 47 exists (FIG. 3).

The projection 44 is provided with a leading slant 49 extending in the direction of the folding movement 25. The size of the partial angle 26 characterizing the intermediate position 30" depends inter alia on the height of the projection 44. In the borderline situation of FIG. 3, the projection 44 is supported on the narrow side of the nose 22' facing the hinge axis 13 illustrated therein. Upon further completion of the folding movement 25, the shoulder 22" moves away again from the projection 44 of the latching member 30" when following its folding movement path 28, already explained in connection with FIG. 2, up to its working position 22'. The released latching member 30" is then returned again as a result of the force effect 41 of the restoring spring 40 into its release position 30 shown in FIG. 2. Upon handle actuation 26, the latching member carries out only a small pendulous movement in the amount of the aforementioned partial angle 46.

The projection 44, as shown in FIG. 4, is positioned on the inner surface 35 of the cam 32. In intermediate position 30" of the latching member of the handle arm has moved into the already mentioned intermediate position 21", in particular, by the angular distance 48 illustrated in FIG. 3. The projection 44 is recessed relative to the end face of the cam 32 limiting the groove 43. In the release position of FIG. 2, the nose 22 is aligned with the entrance of the groove and the groove 43 provides, aside from the afore described pendulous movement 46 at the beginning of actuation, a passage for the nose 22 of the handle arm 21.

List of Reference Numerals

10 housing
11 front side of 10
12 backside of 10
13 hinge axis on 10
14 bearing brackets for 13 on 10
15 depression of 10 on 11
16 outer section of 13 for 21
17 center section of 13 for 20
18 stop on 40 in 10
19 support location on 10 for 39 of 30'
20 folding handle (rest position)
20' working position of 20
21 handle arm 20 (rest position)
21" intermediate position of 21 (FIG. 3)
21'" minimally pivoted position of 21 (FIG. 5)
22 nose on 21 (rest position)
22' intermediate position of 22 (FIG. 3)
22" intermediate position of 22 (FIG. 3)
22'" minimally pivoted position of 22 (FIG. 5)
23 plane of folding movement of 21 (FIG. 1)
24 shoulder on 21
25 folding movement arrow (FIG. 2)
26 arrow of manual handle actuation
27 interior of housing of 10
28 folding movement path of 22 to 22'
29 point of intersection of 28 and 38 (FIG. 2)
30 latching member (working position)
30' support position of 30 (FIGS. 4, 5)
30" intermediate position of 30
31 pivot bearing pin for 30 on 10
32 cam on 30
33 counter cam on 30
34 end face on 33, counter shoulder for 24
35 inner surface of 32
37 counter stop on 30 for 18
38 pivot movement path of 30 (FIG. 2)
39 latching end of 30 (FIGS. 4, 5)
40 restoring spring for 30, tension spring
41 spring force of 40
42 inertia force (FIG. 5)
43 groove between 32, 33
44 projection in 43
45 full angle between 22, 22' (FIG. 2)
46 partial angle between 30, 30", pendulous movement (FIG. 3)
47 gap between 19, 39
48 angular distance between 22, 22" (FIG. 3)
49 leading slant of 44 for 22, 22"

What is claimed is:

1. An outer door handle for vehicles, comprising:

a housing (10) stationarily arranged in a door;

a bearing (14) for supporting a manually actuatable folding handle (20) on the housing (10), wherein the handle (20) is foldable about a hinge axis (13) horizontally arranged or slantedly arranged relative to the horizontal;

wherein the handle (20) has a handle arm (21) and, upon handle actuation (26), acts on a lock arranged within the door;

a pivotable (38) latching member (30) arranged on the stationary housing and serving as a mass latching mechanism active only in a crash situation, wherein the latching member, when inactive, has an ineffective release position (30) relative to a support surface (19) provided on the housing (11), wherein the handle (20)

is not blocked and is actuatable (26) when the latching member (30) is in the ineffective release position;

wherein the latching member (30) in a crash situation, as a result of an inertia of masses of the latching member (30), moves from the ineffective release position into an active support position (30') on the support location (19) and blocks the handle (20);

wherein the latching member (30) has a pivot bearing (31) located on the stationary housing (11);

wherein the movable handle arm (21) has a shoulder (24) and the latching member (30) has a counter shoulder (34);

wherein in a crash situation a folding movement path (28) of the shoulder (24) arranged on the handle arm (21) is intersected (29) by a pivot movement path (38) of the counter shoulder (34) on the latching member (30) so that in the crash situation the shoulder (24) comes to rest against the counter shoulder (34);

wherein in the ineffective release position of the latching member, the shoulder (24) on the handle arm passes the counter shoulder (34) of the latching member (30) when the handle (20) is actuated.

2. The outer door handle according to claim 1, wherein the latching member (30) is subjected to a spring-load (41) in a counter direction to a pivot movement resulting in a crash situation, and wherein the ineffective release position of the latching member (30) is determined by a stop (18) provided on the housing (11), wherein the locking member (30) rests against the stop (18) as a result of the spring-load (41).

3. The outer door handle according to claim 1, wherein the latching member (30) has a projection (44) which already in the ineffective release position of the latching member projects into the folding movement path (28) of the handle arm (21), wherein, when beginning actuation (26) of the handle (20), the handle arm (21) engages the projection (44) and entrains the latching member (30) at least partially, wherein during further handle actuation (26) the handle arm (21) releases the projection (44) before the latching member (30) reaches the active support position (30').

4. The outer door handle according to claim 3, wherein the shoulder (24) is formed by a nose (22) provided on the handle arm (21), wherein the counter shoulder (34) on the latching member (30) forms one flank (33) of a pair of flanks (22, 33) delimiting a groove (43) in the latching member (30), wherein an inner width of the groove (43), without considering the projection (44), is smaller or identical to a width of the nose (22) present on the handle arm (21), wherein in the ineffective release position of the latching member (30) the nose (22) is aligned with an entrance of the groove (43) and the groove (43) forms a passage for the nose (22) upon actuation (26) of the handle (20).

5. The outer door handle according to claim 4, wherein the nose (22) projects laterally from a plane (23) of a folding movement of the handle (20).

6. The outer door handle according to claim 4, wherein the projection (44) is located on a first one of the flanks (32) of the pair of flanks.

7. The outer door handle according to claim 6, wherein the latching member (30) has a cam (32) providing the first flank, wherein an inner surface (35) of the cam (32) facing the groove (43) supports the projection (44).

8. The outer door handle according to claim 7, wherein a second one of the flanks of the pair of flanks opposite the cam (32) is formed by a counter cam located on the latching member (30), wherein the counter cam (33) has an end face forming the counter shoulder (34) for the nose (22) of the handle arm (21).

9. The outer door handle according to claim 8, wherein the projection (44) is recessed relative to the end face of the cam (32) limiting the groove (43).

10. The outer door handle according to claim 3, wherein the projection (44) has a leading slant (49) for engaging the nose (22) provided on the handle arm (21).

11. The outer door handle according to claim 3, wherein the projection (44) has a projection height being passed by the handle arm (21) already after passing through a partial angle (48) of a full angle (45) required for completion of the folding movement path (25) so that the latching member (30) is released by the handle arm and has only passed through a partial portion (46) of the pivot movement path (38) between the ineffective release position (30) and the active support position (30').

12. The outer door handle according to claim 1, wherein the handle (20) is arranged on a visible side (11) of the housing (10), wherein the handle arm (21) is arranged on a back side (12) of the housing (10) and the handle arm (21) with the shoulder (24) moves upon handle actuation (26) from behind into an interior (27) of the housing.

13. The outer door handle according to claim 1, wherein the handle (20) and the handle arm (21) are comprised of two separately manufactured components fixedly connected to one another for common rotation and forming a commonly foldable modular unit.

14. The outer door handle according to claim 13, wherein the handle (20) and the handle arm (21) define an angle in the modular unit and are supported on different sections (17, 16) of the hinge axis (13).

15. The outer door handle according to claim 1, wherein the handle is a pulling handle having an engaging end arranged in the housing and having an opposed handle end moving upon handle actuation a pivot arm supported in the housing and acting on the door lock, wherein the pivot arm embodies the handle arm (21) provided with the shoulder (24).

* * * * *